United States Patent [19]

Hughes

[11] 4,296,706

[45] Oct. 27, 1981

[54] ANCHOR

[75] Inventor: Eugene M. Hughes, Richmond, England

[73] Assignee: The British Petroleum Company Limited, London, England

[21] Appl. No.: 70,442

[22] Filed: Aug. 28, 1979

[30] Foreign Application Priority Data

Jul. 13, 1978 [GB] United Kingdom ..... 29741/78

[51] Int. Cl.[3] ..... B63B 21/24

[52] U.S. Cl. ..... 114/294

[58] Field of Search ..... 114/265, 293, 294, 295, 114/296, 297, 311, 45, 123, 125; 175/8; 405/206, 207, 208, 209

[56] References Cited

U.S. PATENT DOCUMENTS

| | | | |
|---|---|---|---|
| 3,118,416 | 1/1964 | Sawyer | 114/297 |
| 3,431,879 | 3/1969 | Westling | 114/294 |
| 4,092,944 | 6/1978 | Van der Wal | 114/297 |

*Primary Examiner*—Trygve M. Blix
*Assistant Examiner*—Jesús D. Sotelo
*Attorney, Agent, or Firm*—Morgan, Finnegan, Pine, Foley & Lee

[57] ABSTRACT

A gravity anchor for a tethered buoyant platform comprises a container ballasted with a heavier than water ballast such as drilling mud. The anchor is installed by (a) floating the container in a buoyant condition with its interior volume containing air to the offshore installation site, (b) admitting water to, and expelling air from, the interior volume to reduce the buoyancy of the container so that the container is either of reduced positive buoyancy or negatively buoyant, (c) either pulling the container down to the sea bed against its reduced positive buoyancy or lowering the container to the sea bed employing its negative buoyancy, (d) admitting a heavier than water ballast to the container and expelling the water therefrom to further reduce the buoyancy of the container to increase the stability thereof on the sea bed.

5 Claims, 7 Drawing Figures

ANCHOR

This invention relates to an anchor for location on the sea bed for a tethered buoyant platform.

Tethered buoyant platforms, sometimes called tension leg platforms, have been previously proposed for the production of oil and/or gas at offshore locations. A tethered buoyant platform is a platform which, when in use, is moored vertically below its free floating position by means of tethers to which tension is applied.

For mooring a tethered buoyant platform it has been previously proposed to install heavy weights on the sea bed to which the tethers run from the platform. The heavy weights are called gravity anchors. An improved gravity anchor has now been invented.

According to the present invention a gravity anchor for a tethered buoyant platform comprises a container having an interior volume, the anchor being floatable to an offshore installation site by being buoyant when filled with air, the container having a first opening for the admission of water and heavier than water ballast and one or more second openings for the discharge of air and water whereby the container can first be flooded to reduce the buoyancy thereof to facilitate installation on the sea bed and then ballasted with the heavier than water ballast to further reduce the buoyancy and increase the stability thereof on the sea bed.

The container can have one or more buoyancy tanks, and conveniently the buoyancy tanks are floodable.

Conveniently the container has a skirt to penetrate the sea bed and reduce the vulnerability of the anchor to scouring.

The container can conveniently be made of steel or concrete.

The gravity anchor can have a distribution means for distributing the heavier than water ballast within the container.

The distribution means can comprise a pipe disposed vertically and communicating with the opening for the admission of the ballast, the pipe terminating in a chamber where the ballast is caused to flow radially outward and then vertically upwards in an annulus between the pipe and a partition and flow over the upper end of the partition.

According to one embodiment of the invention there is provided a gravity anchor installed on the sea bed and the interior volume of the container contains heavier than water ballast.

The heavier than water ballast can be in the form of pumpable slurry and the anchor can be recoverable to the surface by displacing the slurry from the interior volume with water and optionally pumping in air to displace the water.

According to another aspect of the present invention a method of installing a gravity anchor for a tethered buoyant platform at an offshore installation site the gravity anchor having an interior volume comprises:

(a) transporting the container to the offshore installation site, (b) admitting water to, and expelling air from, the interior volume to reduce the buoyancy of the container so that the container is either of reduced positive buoyancy or negatively buoyant, (c) either pulling the container down to the sea bed against its reduced positive buoyancy or lowering the container to the sea bed employing its negative buoyancy, (d) admitting a heavier than water ballast to the container and expelling the water therefrom to further reduce the buoyancy of the container and increase the stability thereof on the sea bed.

The container can have one or more buoyancy tanks which tanks contain air during the floatation to the installation site and the method comprises flooding the tanks to assist in installing the container on the sea bed.

Conveniently the heavier than water ballast is a weighted slurry such as a drilling mud.

The invention is illustrated with reference to the accompanying drawings in which FIG. 1 is a vertical section of a gravity anchor for a tethered buoyant platform.

Figure 1:
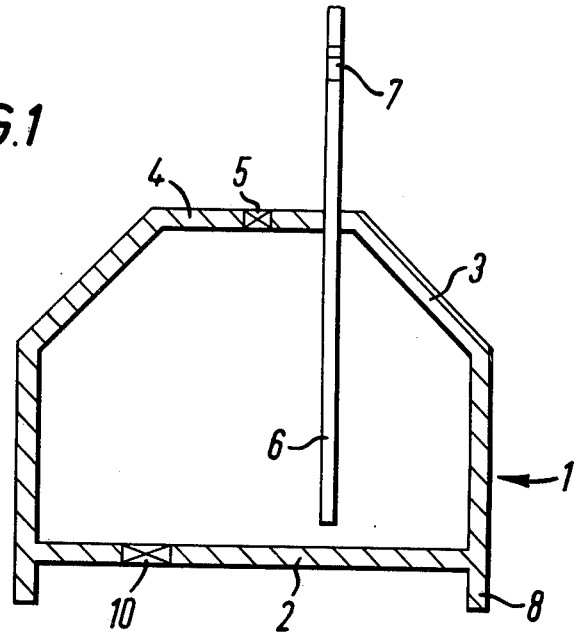

With reference to FIG. 1 the anchor comprises a container 1 made of concrete which is circular in plan view and has a flat floor 2, an antiscour skirt 8 and a generally conical roof 3 with a flat top portion 4. The container 1 is controllably floodable by means of a valve controlled opening 10 located in the floor 2. Located in the flat top portion 4 of the roof 3 is another valve controlled opening 5 and a length of drill pipe 6 passes through a further opening in the top portion 4 to provide communication between the interior of the container and the exterior thereof. The drill pipe 6 extends to just short of the floor 2 and in the portion of drill pipe 6 above the roof 4 is a coupling in the form of a breakable joint 7.

In use the container 1 is floated full of air from its fabrication site to an offshore location. Valve controlled opening 10 is opened and the container is lowered on the drill pipe 6 from the surface of the water, the water level inside the container 1 being controlled to assist the operation.

When the container 1 rests on the sea bed, valve 5 is opened and denser ballast, e.g. drilling mud or weighted cement slurry is passed into the container 1 through the drill pipe 6. The ballast displaces the water through valve 5.

When the container is full as indicated by a suitable pressuring device (not shown) the ballasting is stopped and the drill pipe 6 broken at the joint 7 and recovered.

A cable or chain or the like can be attached to the anchor by means of a shackle or the like (not shown) set into the concrete container 1.

Figure 2:
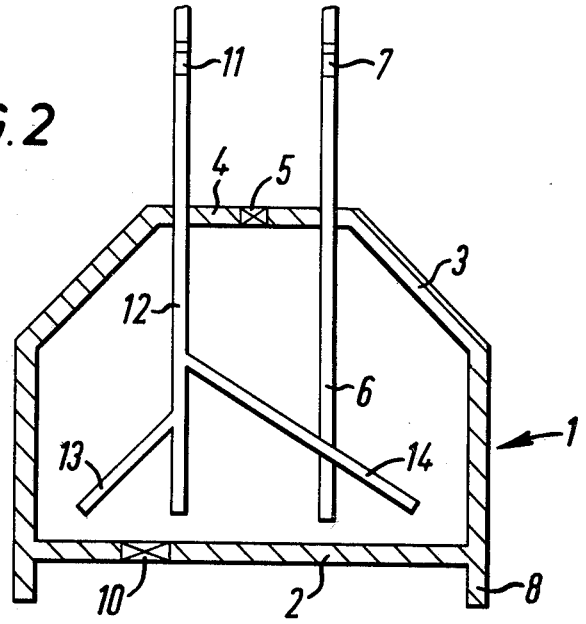
FIG. 2 is a vertical section of an alternative embodiment.

In an alternative embodiment illustrated in FIG. 2 to enable the container to be recovered a second length of drill pipe 12 is cast into the flat portion of the roof 4 and has at its upper end a female part of a safety joint 11. The length of drill pipe 12 inside the container 1 has a bifurcation in branches 13 and 14. Attached to joints 7 and 11 are wire guide lines the latter having at their distant ends sonar buoys (not shown). Valve 5 can be omitted since water can be displaced through valve 10 which is held below the surface.

In use the ballasting operation is effected as described above with the exception that the denser than water ballast is a thixotropic gel. To recover the container 1 the tension tethers (not shown) are slackened and the sonar buoys released to the surface. Using the guide lines, drill pipes are inserted into joints 7 and 11 from a surface vessel and the joints made tight.

A pump on the surface pumps water through the pipes 12, 13 and 14 agitating the ballast and displacing it via pipe 6 to a mud tank on the surface.

When all the ballast has been displaced, drill pipe 6 is broken at the safety joint 7 and recovered. The container 1 is then raised on drill pipe 12 and valve 10 is opened at the surface to release sufficient water to enable the container 1 to float.

Figure 3:
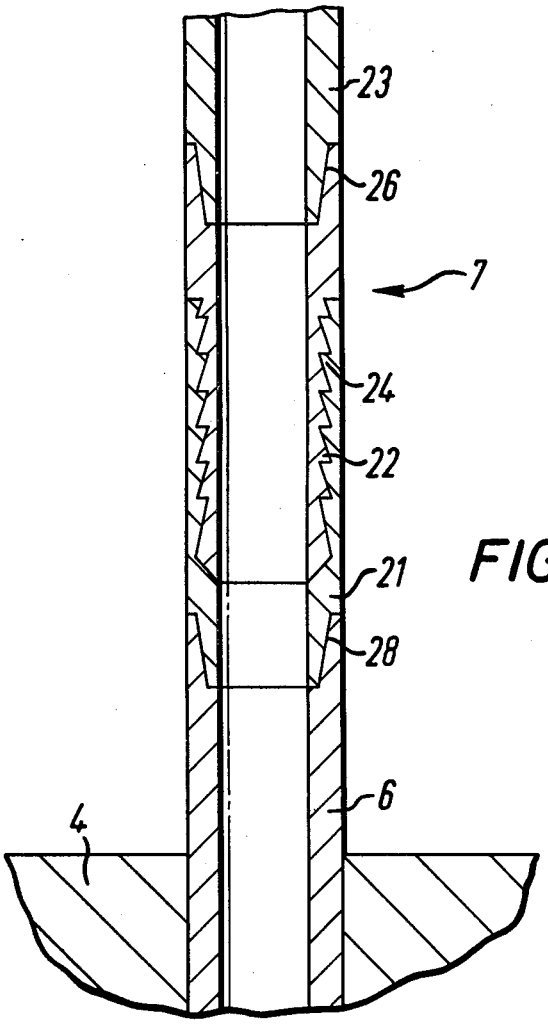
FIG. 3 is a vertical section on a larger scale than FIGS. 1 and 2 of a breakable joint.

With reference to FIG. 3, drill pipe 23 is connected to drill pipe 6 by means of a joint indicated generally by reference number 7. The joint 7 comprises a tubular member 22 joined to pipe 23 at screw thread 26 and having an external screw thread 24 engaging an internal screw thread on tubular member 21 which is also joined to pipe 6 at screw thread 28.

Figure 4:
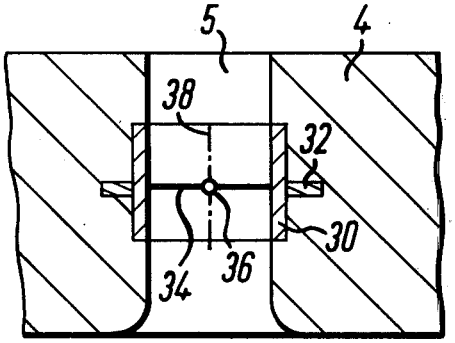
FIG. 4 is a vertical section also on a larger scale than FIGS. 1 and 2 of a valve used in the present invention.

With reference to FIG. 4, the valve 5 comprises a valve housing pipe 30 set into the concrete roof 4 having a puddle flange 32 and a spring controlled gate 34 which can pivot on axis 36 to an open position 38.

Figure 5:
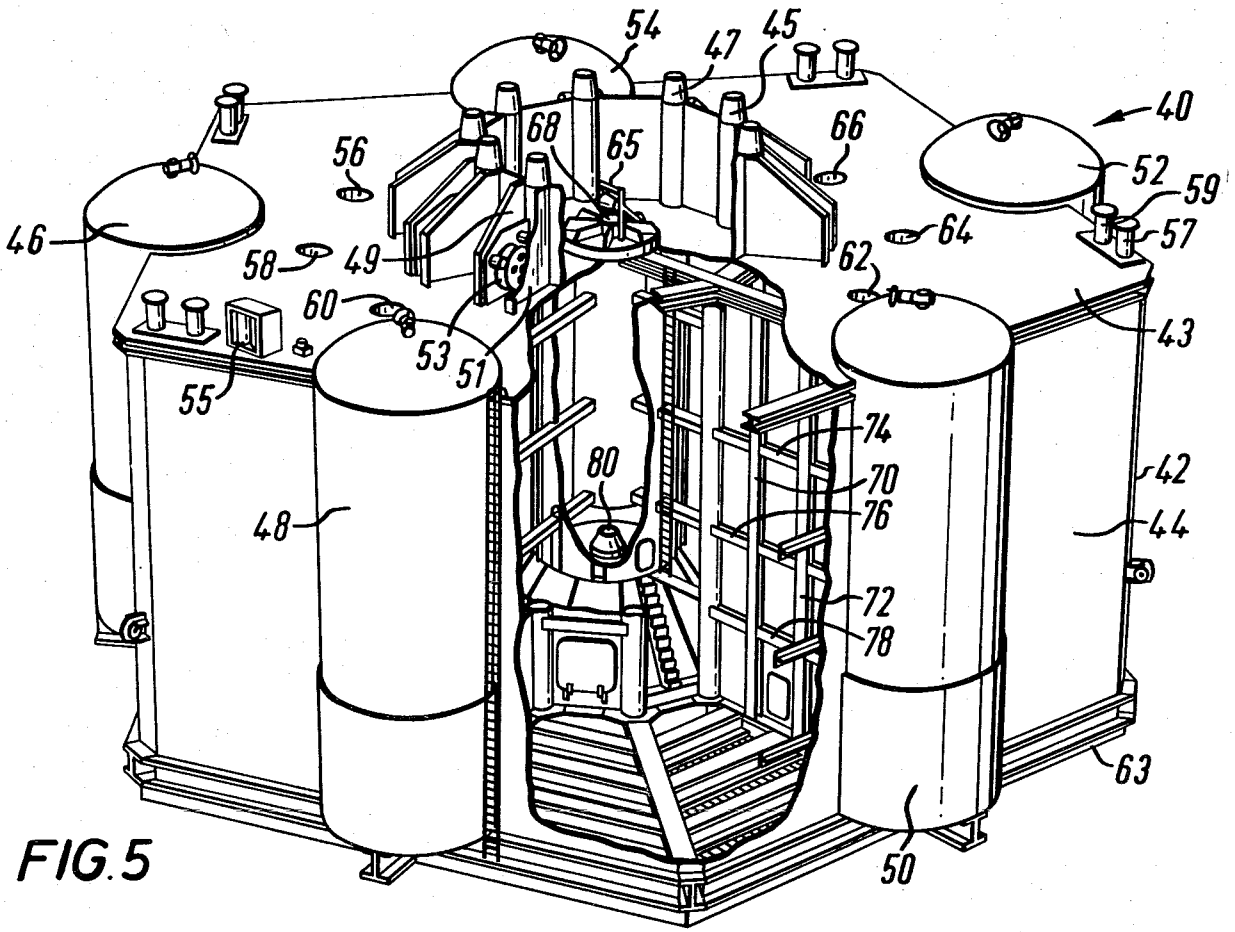
FIG. 5 is a perspective view of another embodiment of the gravity anchor according to the invention partly cut away to show the internal structure.
Figure 6:
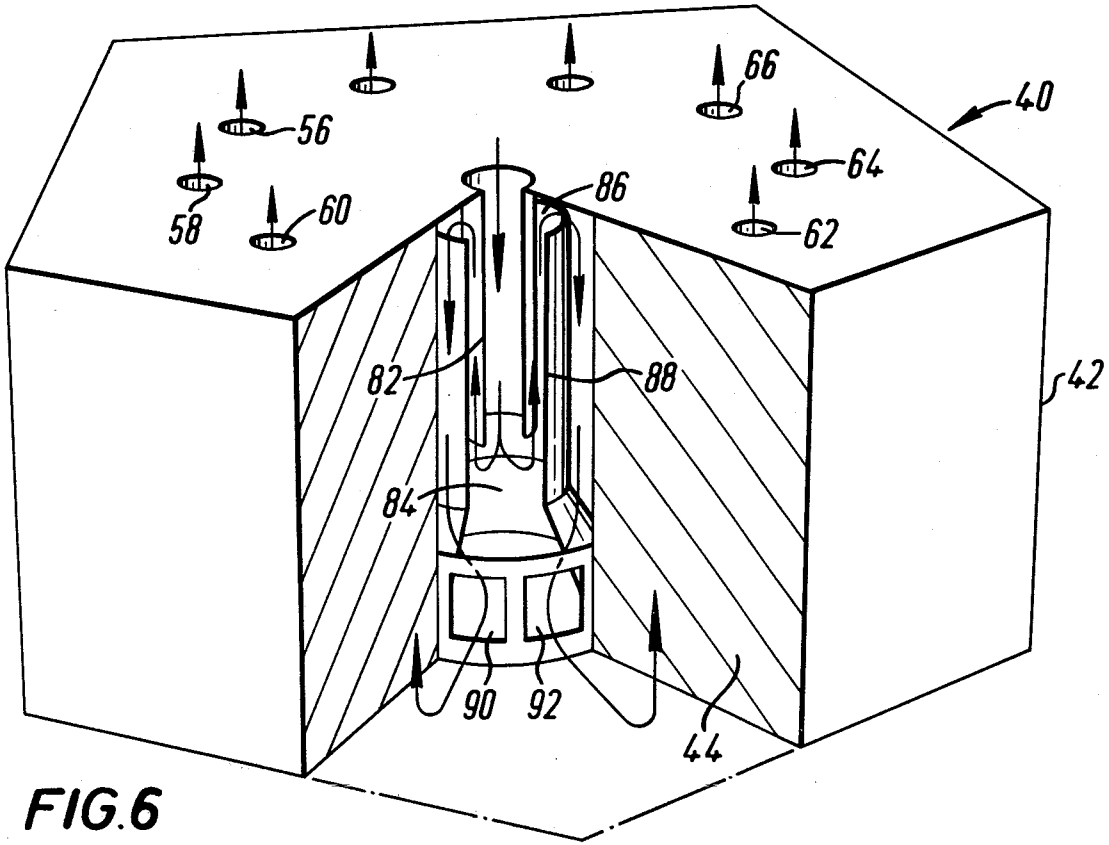
FIG. 6 is a simplified perspective view of the embodiment shown in FIG. 5, partly cut away to show the flow of ballast in the ballasting operation.
Figure 7:
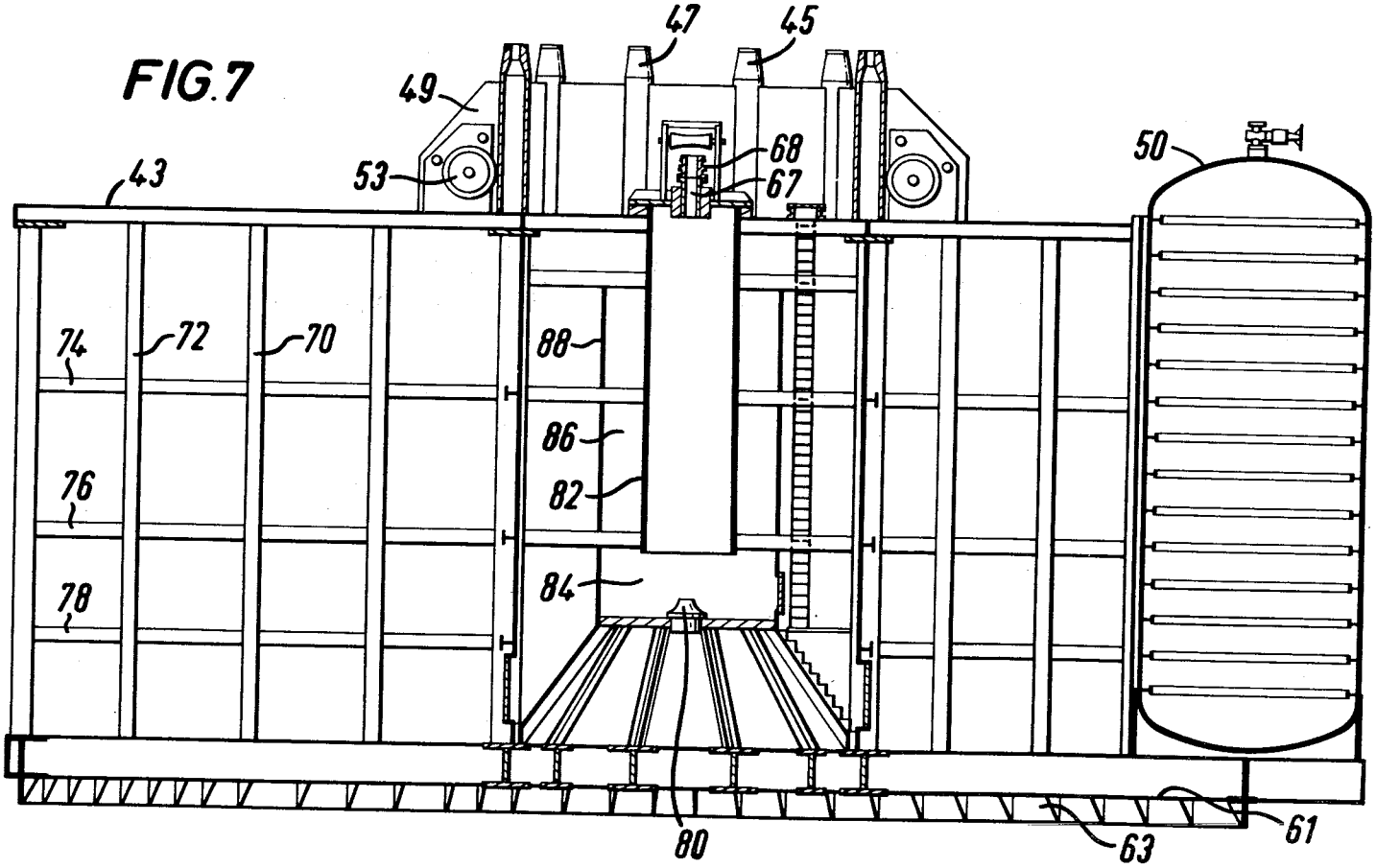
FIG. 7 is a vertical section through the vertical axis of the anchor shown in FIGS. 5 and 6.

Referring to FIGS. 5, 6 and 7, the gravity anchor indicated generally by numeral 40 comprises a steel container 42 having an interior volume 44 and five buoyancy tasks 46, 48, 50, 52 and 54. At the upper surface of the container are openings 56, 58, 60, 62, 64 and 66 which can be valve controlled for the expulsion of air when flooding, or water when ballasting. Centrally located is an opening 67 for the admission of water and ballast and a connector 68 for a riser (not shown) for supplying the ballast. The connector 68 connects the riser to a central tube 82 into which the ballast is fed. The ballast flows down to the lower end of tube 82 into a chamber 84 where the flow is caused to reverse and pass up the annulus 86 between the tube 82 and the partition 88, and to flow over the upper end of partition 88 which acts as a weir. The ballast then flows down to ten apertures only two of which 90 and 92 are shown and then to the main part of the interior volume 44 of the container. Interconnecting steel supporting and reinforcing members 70, 72, 74, 76 and 78 extend within the interior volume 44 to strengthen the container. Also centrally located near the base of the container is a connector 80 to mate with another connector (not shown) for hauling the container down to the sea bed during installation.

At the top 43 of the container are mounted ten anchor posts (only eight of which are shown in FIG. 5) 45 and 47 (the remainder being unnumbered). Each anchor post is supported by a pair of reinforcing plates 49 and 51 each pair having located therebetween a removable tether haul down pulley 53. Also mounted on the top 43 of the container is a fairlead 55 for a haul down messenger line (not shown) and centrally located is a temporary fairlead 65 for a haul down messenger line (also not shown). At each corner of the generally hexagonal container are twin bollards 57 and 59. At the base 61 of the container is a skirt 63.

Prior to installation of the anchor 40, a number of piles, conveniently two, are driven into the sea bed to provide reaction points for the haul down. The anchor 40 is floated to the installation site and the container interior volume 44 flooded by pumping in water through the central opening 67. The anchor then has a small positive buoyancy and, employing a haul down line anchored to the piles, the anchor 40 is hauled down to a position near the sea bed. The buoyancy tanks 46, 48, 50, 52 and 54 are then flooded by releasing the air contained in them and the anchor 40 settles on the sea bed. Ballast, which is conveniently a heavy weighted slurry, such as drilling mud, is then pumped into the interior volume 44 via a riser (not shown) connected to connection 68 to displace the water which is expelled through openings 56 to 66.

If at a later date, it is desired to recover the anchor 40, water can be pumped down into the container interior volume 44 under pressure to agitate the ballast, and the agitated mixture of water and ballast pumped out. Air can be pumped into the buoyancy tanks and the anchor floated or hauled up to the surface.

In a modified installation procedure the anchor can be transported in a non buoyant condition to the installation site employing a barge or similar surface vessel. At the installation site the anchor can then be lowered to the sea bed employing its negative buoyancy. It can then be ballasted as described above.

I claim:

1. A gravity anchor suitable for a tethered buoyant platform comprising a container having an interior volume, the anchor being floatable to an offshore installation site by being bouyant when filled with air, the container having a first opening for the admission of water and heavier than water ballast and one or more second openings for the discharge of air and water whereby the container can first be flooded to reduce the bouyancy thereof to facilitate installation on the sea bed and then ballasted with the heavier than water ballast to further reduce the bouyancy and increase the stability thereof on the sea bed; said anchor including a distribution means for distributing the heavier than water ballast within the container, and wherein the distribution means comprises a pipe disposed vertically and communicating with the opening for the admission of the ballast, the pipe terminating in a chamber where the ballast is caused to flow radially outward and then vertically upwards in an annulus between the pipe and a partition and flow over the upper end of the partition.

2. A gravity anchor suitable for a tethered bouyant platform comprising a container having an interior volume, the anchor being floatable to an off shore installation site by being bouyant when filled with air, the container having a first opening for the admission of water and heavier than water ballast in the form of a slurry, the container having one or more second openings for the discharge of air and water whereby the container can first be flooded to reduce the bouyancy thereof to facilitate installation on the sea bed, then ballasted with the heavier than water ballast to further reduce the bouyancy and increase the stability thereof on the sea bed, and then increased in bouyancy by pumping in water to agitate the ballast for expulsion thereof to facilitate recovery of the anchor; said anchor further including a distribution system which comprises a weir upstanding from a floor of said container, and a conduit of conducting ballast from one of said second openings downwardly into said weir.

3. An anchor according to claim 2 further comprising bouyancy tanks affixed to said container, said weir conducting ballast to said interior volume alongside said bouyancy tanks.

4. A gravity anchor comprising:

a set of bouyancy tanks;

a container affixed to said tanks and having an interior volume for the reception of liquid ballast;

a conduit extending vertically to the interior of said container from an opening in an upper surface of said container; and a wall upstanding from a floor of said container and surrounding an opening at the bottom of said conduit to serve as a weir for the distribution of ballast conducted into said container via said conduit.

5. An anchor according to claim 4 further comprising a set of ports positioned about the lower edge of said wall, and externally thereto for conducting the ballast past said weir into individual portions of said container located among said tanks.

* * * * *

UNITED STATES PATENT AND TRADEMARK OFFICE

CERTIFICATE OF CORRECTION

PATENT NO. : 4,296,706

DATED : October 27, 1981

INVENTOR(S) : Eugene M. Hughes

It is certified that error appears in the above—identified patent and that said Letters Patent is hereby corrected as shown below:

In Col. 4, line 65, "of", first occurrence, should read -- for --.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*